US012790102B2

(12) United States Patent
Khalaf

(10) Patent No.: US 12,790,102 B2
(45) Date of Patent: Nov. 10, 2026

(54) APPARATUS TO HOLD ELECTRICAL COMPONENTS THAT ACCOMMODATES MULTIPLE ELECTRICAL COMPONENT SIZES

(71) Applicant: SK Hynix NAND Product Solutions Corp., Rancho Cordova, CA (US)

(72) Inventor: Bilal Khalaf, Folsom, CA (US)

(73) Assignee: Solidigm Inc., Rancho Cordova, CA (US)

( * ) Notice: Subject to any disclaimer, the term of this patent is extended or adjusted under 35 U.S.C. 154(b) by 0 days.

(21) Appl. No.: 18/927,358

(22) Filed: Oct. 25, 2024

(65) Prior Publication Data

US 2026/0116645 A1 Apr. 30, 2026

(51) Int. Cl.
*B65D 85/30* (2006.01)
*B65D 1/34* (2006.01)
*B65D 25/10* (2006.01)

(52) U.S. Cl.
CPC ..... *B65D 85/30* (2013.01); *B65D 1/34* (2013.01); *B65D 25/108* (2013.01)

(58) Field of Classification Search
CPC ..... B65D 25/108; B65D 25/10; B65D 85/30; B65D 1/34; B65D 73/02; B65D 2585/86; A45C 2011/188
USPC ..... 206/706
See application file for complete search history.

(56) References Cited

U.S. PATENT DOCUMENTS

| | | | | |
|---|---|---|---|---|
| 5,915,548 | A * | 6/1999 | Sasaki | G11B 33/0433 206/387.13 |
| 6,474,476 | B1 | 11/2002 | Anderson et al. | |
| 7,293,647 | B2 * | 11/2007 | Wong | B65D 25/10 |
| 7,475,816 | B1 * | 1/2009 | Rochelo | A45C 11/18 235/487 |
| 8,662,295 | B2 * | 3/2014 | Kubota | G06K 19/005 206/307 |
| 2006/0144751 | A1 * | 7/2006 | Tsang | G11B 33/0455 206/707 |
| 2007/0215517 | A1 | 9/2007 | Holler | |
| 2020/0163262 | A1 | 5/2020 | Oliverius | |

FOREIGN PATENT DOCUMENTS

| | | | |
|---|---|---|---|
| JP | 10-079419 | A | 3/1998 |
| JP | 2001-122328 | A | 5/2001 |

* cited by examiner

*Primary Examiner* — Steven A. Reynolds
(74) *Attorney, Agent, or Firm* — HG LAW LLP

(57) ABSTRACT

An apparatus for holding electrical components and a method for securing electrical components therein, wherein the apparatus includes a major plane, a top side and a bottom side, each parallel to the major plane, and a plurality of recesses in the top side. A depth of each of the plurality of recesses is based on the bottom side. Each respective recess includes a plurality of mounting moles, wherein each mounting hole is configured to accommodate a respective size of an electrical component, and oriented differently from others of the plurality of mounting holes.

20 Claims, 9 Drawing Sheets

APPARATUS TO HOLD ELECTRICAL COMPONENTS THAT ACCOMMODATES MULTIPLE ELECTRICAL COMPONENT SIZES

TECHNICAL FIELD

The present disclosure is directed to apparatuses for holding electrical components and more particularly to apparatuses for holding electrical components capable of holding electrical components of different sizes.

SUMMARY

In accordance with the present disclosure, apparatuses for holding electrical components and methods for securing electrical components therein are provided to accommodate multiple sizes and/or shapes of electrical components. The apparatus disclosed herein includes a major plane, a top side and bottom side, each parallel to the major plane, and multiple recesses. Each recess arranged in the apparatus includes more than one mounting hole, where each mounting hole is (1) configured to accommodate a respective size of an electrical component and (2) oriented differently from the other mounting holes. The apparatuses and methods for securing electrical components therein disclosed herein are provided to accommodate multiple sizes and/or shapes of electrical components in each recess arranged in the apparatus.

BRIEF DESCRIPTION OF THE DRAWINGS

The following description includes discussion of figures having illustrations given by way of example of implementations of embodiments of the disclosure. The drawings should be understood by way of example, and not by way of limitation. As used herein, references to one or more "embodiments" are to be understood as describing a particular feature, structure, and/or characteristic included in at least one implementation. Thus, phrases such as "in one embodiment" or "in an alternate embodiment" appearing herein describe various embodiments and implementations, and do not necessarily all refer to the same embodiment. However, they are also not necessarily mutually exclusive.

DETAILED DESCRIPTION

Figure 1:
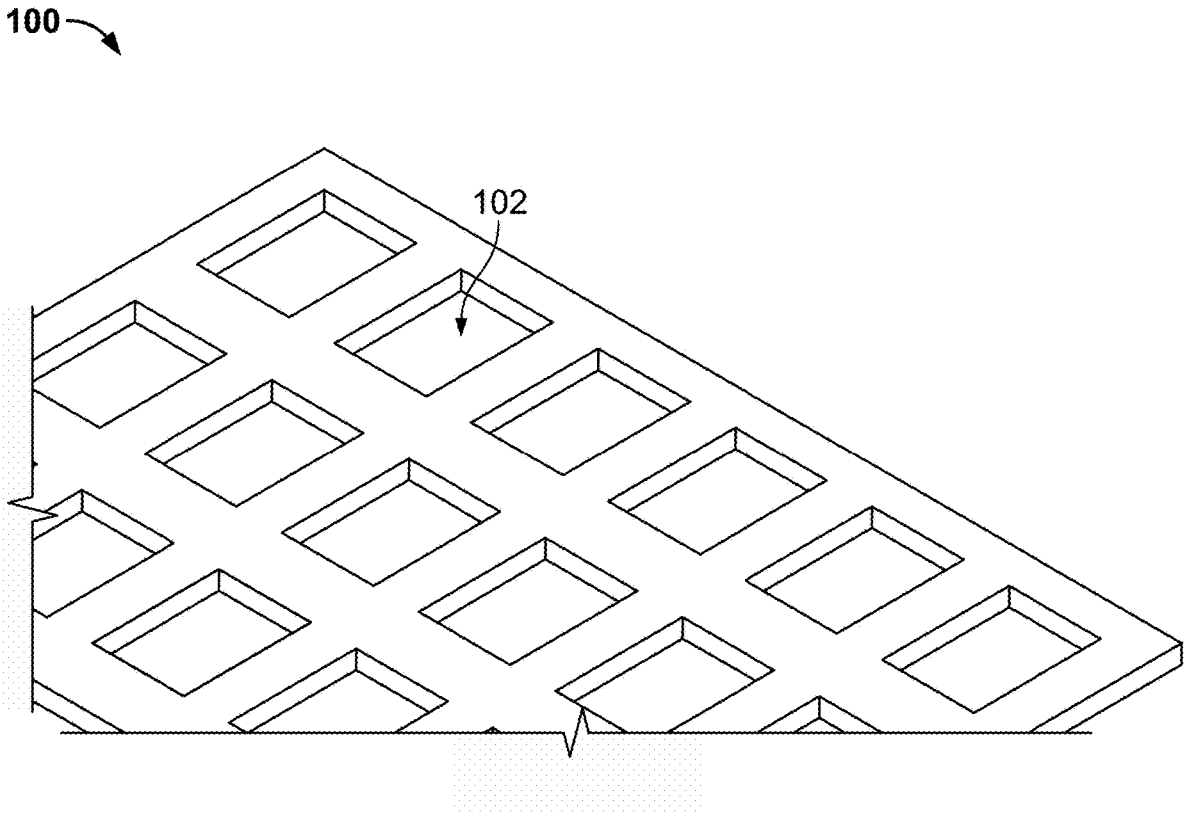
FIG. 1 shows an illustrative isometric view diagram of an apparatus with recesses.

In accordance with the present disclosure, apparatuses and methods for securing electrical components therein disclosed herein are provided to accommodate multiple sizes and/or shapes of electrical components in each recess arranged in the apparatus. For example, each recess may include a first mounting hole of a first size (e.g., defined by a first width $W_1$ and a first length $L_1$) and a second mounting hole of a second size (e.g., defined by a second width $W_2$ and a second length $L_2$), where each of the first size and the second size are different from each other. In some embodiments, both the first width $W_1$ and the second width $W_2$ may be the same. In some embodiments, both the first length $L_1$ and the second length $L_2$ may be the same. Each of the first mounting hole and second mounting hole is configured to accommodate an electrical component of a size corresponding to the respective size of the mounting hole (e.g., first size of the first mounting hole or the second size of the second mounting hole.

Each recess includes multiple mounting holes, where each respective mounting hole is arranged according to a respective orientation. For example, when a respective recess includes a first mounting hole and a second mounting hole, the first mounting hole is arranged according to a first orientation $\theta_1$ and the second mounting hole is arranged according to a second orientation $\theta_2$. The second orientation $\theta_2$ may be separated from the first orientation $\theta_1$ by any suitable angle to secure an electrical component in one of the first mounting hole and the second mounting hole.

Each recess may include more than two mounting holes to accommodate electrical components of additional sizes and shapes. Each mounting hole of a recess may be of any size or shape corresponding to that of an electrical component to accommodate and secure the electrical component.

For purposes of brevity and clarity, the features of the disclosure described herein are in the context of an apparatus with recesses to accommodate electrical components. However, the principles of the present disclosure may be applied to any other suitable context in which an apparatus is configured to hold electrical components.

In particular, the present disclosure provides apparatuses and methods for securing electrical components therein disclosed herein are provided to accommodate multiple sizes and/or shapes of electrical components in each recess arranged in the apparatus.

In some embodiments, the electrical components may include one or more integrated circuit (IC) packages, or one or more passive electrical components (e.g., capacitor, resistor, inductor).

In some embodiments, the apparatus is comprised of a polymer (e.g., plastic) material. The apparatus in which the recesses are disposed may be in the form of a tray, reel or any other suitable form factor for holding electrical components as described herein.

The subject matter of this disclosure may be better understood by reference to FIGS. 1-7.

FIG. 1 shows an illustrative isometric view diagram of an apparatus 100 with recesses 102. Apparatus 100 includes recesses 102 distributed in a grid, each recess 102 of the same shape, same size and same orientation. Each recess 102 of apparatus 100 is configured to accommodate a particular electrical component of a particular size and shape. Therefore, apparatus 100 is incapable of accommodating an electrical component that is not of that particular size and shape.

Figure 2A:
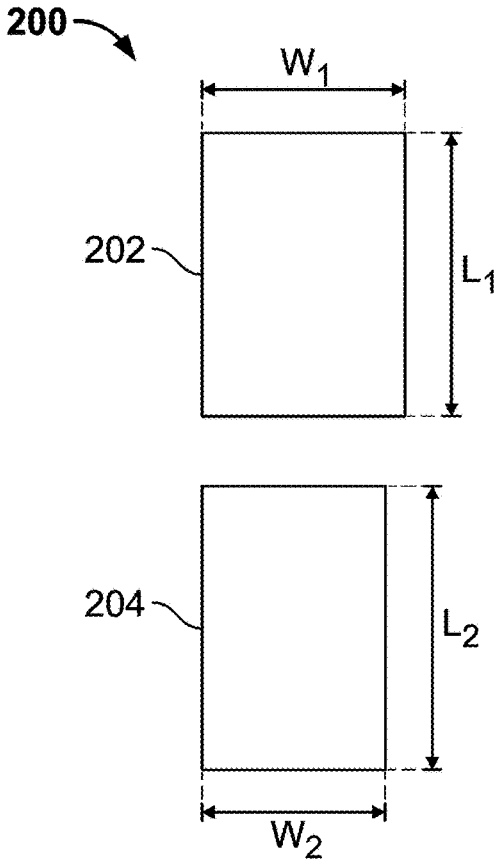
FIGS. 2A and 2B respectively show an illustrative isolated plan diagram and superimposed plan diagram of mounting holes of a recess, in accordance with some embodiments of the present disclosure.
Figure 2B:
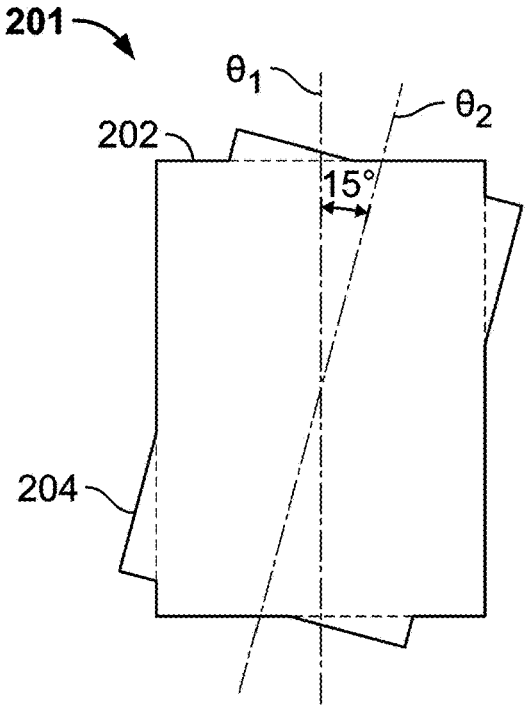

FIGS. 2A and 2B respectively show an illustrative isolated plan diagram 200 and a superimposed plan diagram of mounting holes (e.g., first mounting hole 202 and second mounting hole 204) of a recess 201, in accordance with some embodiments of the present disclosure. As shown in plan diagram 200, first mounting hole 202 is of a first size (e.g., defined by first width $W_1$ and first length $L_1$) and second mounting hole 204 is of a second size (e.g., defined by second width $W_2$ and second length $L_2$). Each of the first size and the second size are different from each other. In some embodiments, both the first width $W_1$ and the second width $W_2$ may be the same. In some embodiments, both the first length $L_1$ and the second length $L_2$ may be the same. Each mounting hole (e.g., first mounting hole 202 and second mounting hole 204) is configured to accommodate an electrical component of a size corresponding to the respective size of the mounting hole (e.g., first size of first mounting hole 202 or second size of second mounting hole 204).

Recess 201 includes each of the first mounting hole 202 and second mounting hole 204, where each respective mounting hole (e.g., first mounting hole 202 and second mounting hole 204) is arranged with a respective orientation (e.g., first orientation $\theta_1$ and second orientation $\theta_2$). The first mounting hole 202 is arranged according to the first orientation $\theta_1$ and the second mounting hole 204 is arranged according to the second orientation $\theta_2$. As shown in FIG. 2B, the second orientation $\theta_2$ is +15° from the first orientation $\theta_1$. Although FIG. 2B shows the second orientation $\theta_2$ separated from the first orientation $\theta_1$ by 15°, the second orientation $\theta_2$ may be separated from the first orientation $\theta_1$ by any suitable angle to secure an electrical component in each mounting hole (e.g., first mounting hole 202 or second mounting hole 204).

Although recess 201 includes two mounting holes (e.g., first mounting hole 202 and second mounting hole 204), recess 201 arranged on an apparatus may include more than two mounting holes to accommodate electrical components of additional sizes and shapes. Although each mounting hole (e.g., first mounting hole 202 and second mounting hole 204) of recess 201 is of a respective size and shape, each mounting hole (e.g., first mounting hole 202 and second mounting hole 204) and any additional mounting holes of recess 201 may be of a size or a shape corresponding to that of an electrical component to secure the electrical component. For example, although each mounting hole (e.g., first mounting hole 202 and second mounting hole 204) is of a rectangular shape, each mounting hole (e.g., first mounting hole 202 and second mounting hole 204) may be of any other suitable shapes to accommodate a corresponding shape of an electrical component.

For purposes of clarity and brevity, and not by way of limitation, the present disclosure is provided in the context of an apparatus with recesses 201, each of which provides the features and functionalities disclosed herein. The apparatus in which the recesses 201 are disposed may be at least partially implemented with plastic or polymers in the form of a tray, reel or any other suitable form factor for holding electrical components as described herein.

Figure 3A:
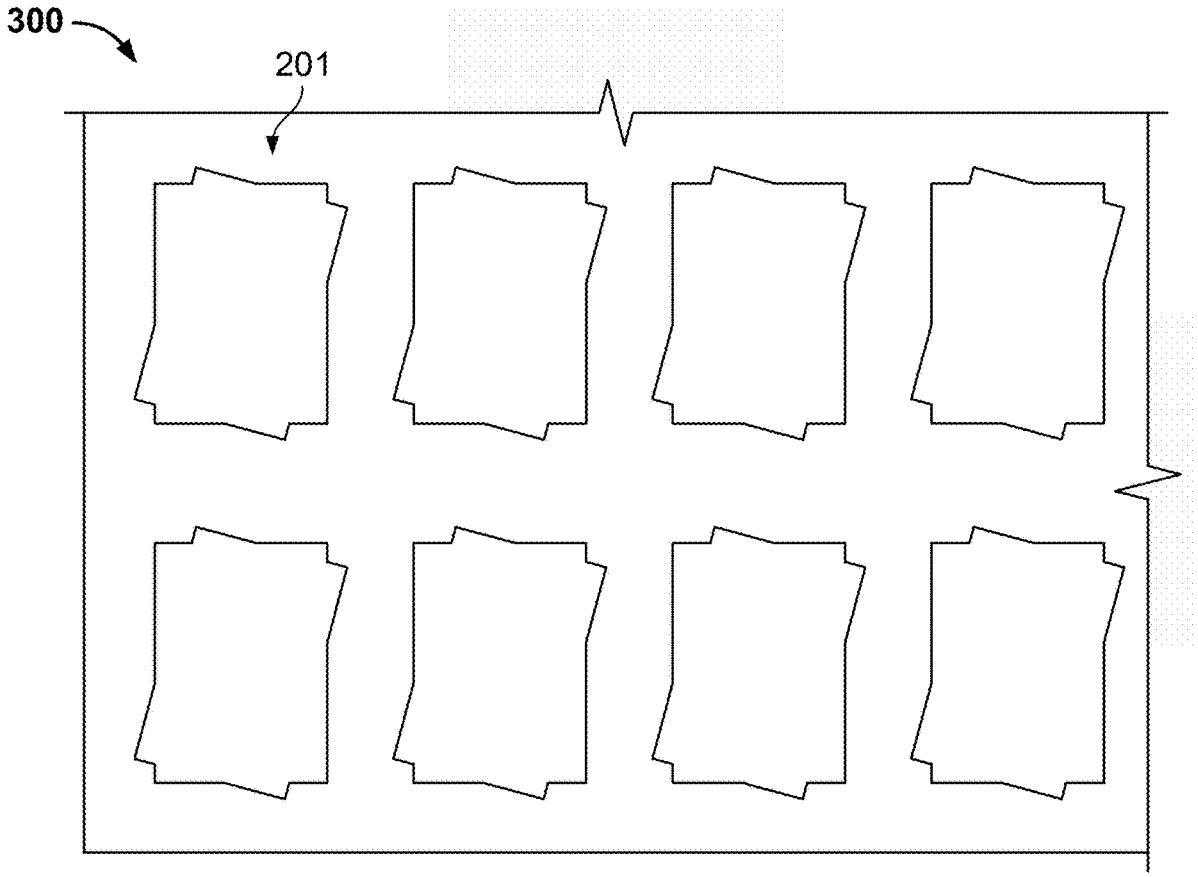
FIGS. 3A and 3B respectively show an illustrative plan view diagram and isometric view diagram of an apparatus with recesses similar to that of FIG. 2B, in accordance with some embodiments of the present disclosure.
Figure 3B:
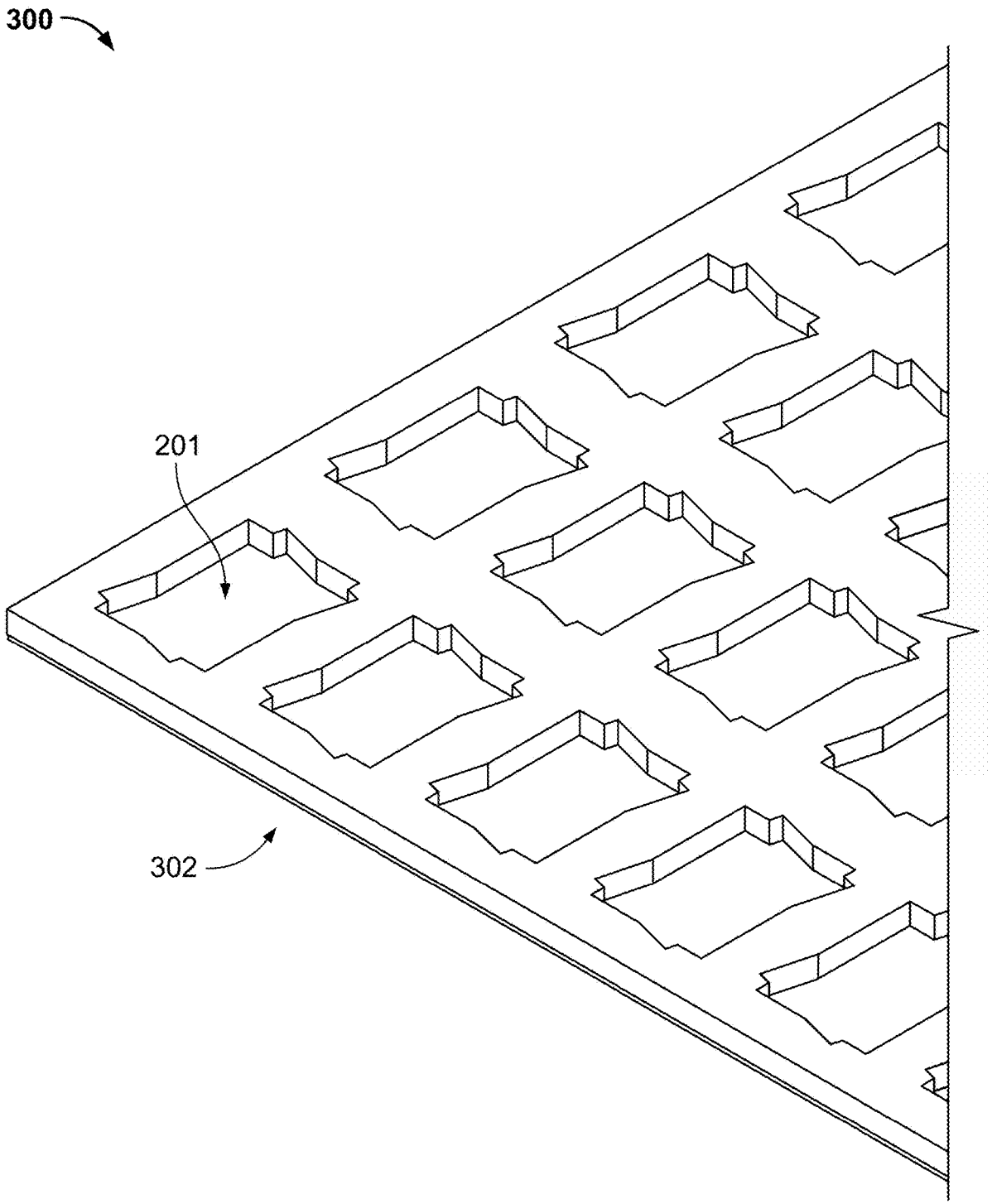

FIGS. 3A and 3B respectively show an illustrative plan view diagram and isometric view diagram of an apparatus 300 with recesses (e.g., recess 201) similar to that of FIG. 2B, in accordance with some embodiments of the present disclosure. Apparatus 300 includes at least one recess 201 with multiple mounting holes, where each mounting hole accommodates an electrical component of a respective size. Additionally, apparatus 300 includes a major plane, a top side in which the recesses are disposed, and a bottom side 302, where each of the top side and bottom side 302 are parallel to the major plane. In some embodiments, each recess 201 extends from the top side in a direction toward the bottom side 302. The depth of each recess 201 is based on the bottom side 302 such that the bottom side 302 forms further support, along with a respective mounting hole of a recess 201, to accommodate and hold an electrical component.

Although recesses 201 are uniformly distributed throughout apparatus 300 in a grid-like arrangement, recesses 201 may be distributed throughout apparatus 300 in any suitable manner. However, each recess 201 should not coincide with any other recess disposed in the apparatus 300 such that the recesses 201 cannot hold an electrical component in any one mounting hole of the recesses 201.

It will be understood that, while apparatus 300 depicts an embodiment in which bottom side 302 forms a solid base to hold, along with the recess 201, an electrical component, bottom side 302 may include holes, where each hole extends through the bottom side 302 and is arranged in each respective recess (e.g., recess 201). Each hole disposed within a respective recess (e.g., recess 201) may be of any size or shape that may be disposed within the respective recess (e.g., recess 201).

Figure 4A:
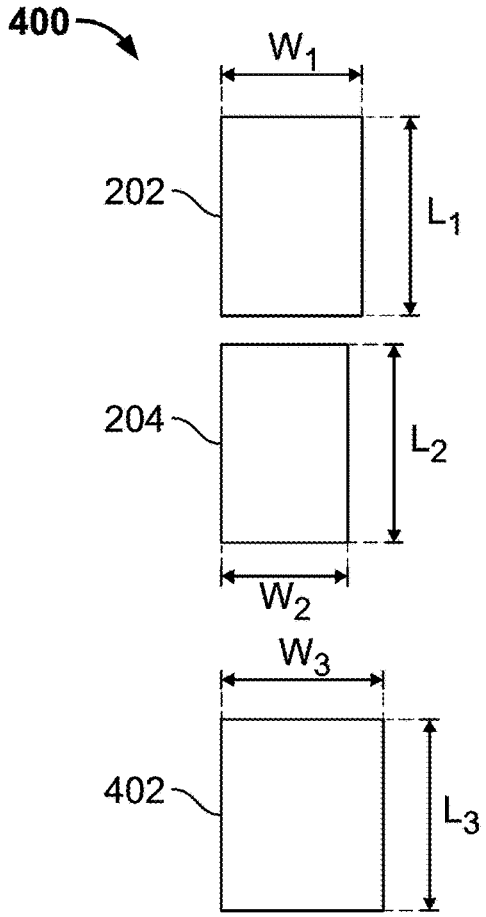
FIGS. 4A and 4B respectively show an illustrative isolated plan diagram and superimposed plan diagram of mounting holes of another recess, in accordance with some embodiments of the present disclosure.
Figure 4B:
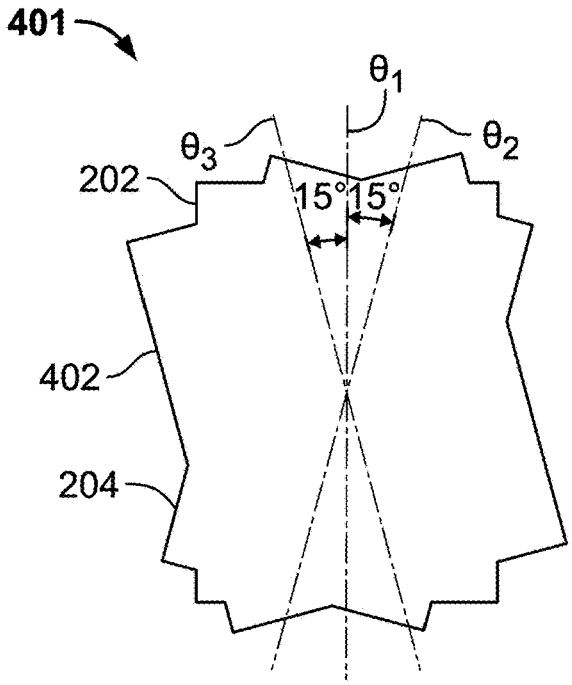

FIGS. 4A and 4B respectively show an illustrative isolated plan diagram 400 and superimposed plan diagram of mounting holes (e.g., first mounting hole 202, second mounting hole 204, and third mounting hole 402) of another recess 401, in accordance with some embodiments of the present disclosure. As shown in plan diagram 400, first mounting hole 202 is of a first size (e.g., defined by first width $W_1$ and first length $L_1$), second mounting hole 204 is of a second size (e.g., defined by second width $W_2$ and second length $L_2$), and third mounting hole 402 is of a third size (e.g., defined by third width $W_3$ and third length $L_3$). Each of the first size, second size, and third size are different from each other size. In some embodiments, two or more of first width $W_1$, second width $W_2$, and third width $W_3$ may be of a same width. In some embodiments, two or more of first length $L_1$, second length $L_2$, and third length $L_3$ may be of a same length. Each mounting hole (e.g., first mounting hole 202, second mounting hole 204, and third mounting hole 402) is configured to accommodate an electrical component of a size corresponding to the respective size of the mounting hole (e.g., first size of first mounting hole 202, second size of second mounting hole 204, or third size of third mounting hole 402).

Recess 401 includes each of the first mounting hole 202, second mounting hole 204, and third mounting hole 402, where each respective mounting hole (e.g., first mounting hole 202, second mounting hole 204, and third mounting hole 402) is arranged with a respective orientation (e.g., first orientation $\theta_1$, second orientation $\theta_2$, and third orientation $\theta_3$). The first mounting hole 202 is arranged according to the first orientation $\theta_1$, the second mounting hole 204 is arranged according to the second orientation $\theta_2$, and the third mounting hole 402 is arranged according to the third orientation $\theta_3$. As shown in FIG. 4B, the second orientation $\theta_2$ is +15° from the first orientation $\theta_1$, and the third orientation $\theta_3$ is −15° from the first orientation $\theta_1$. Although FIG. 4B shows each of the second orientation $\theta_2$ and the third orientation $\theta_3$ separated by 15° from the first orientation $\theta_1$, each of the second orientation $\theta_2$ and the third orientation $\theta_3$ may be separated by any suitable angle from the first orientation $\theta_1$ to secure an electrical component in each mounting hole (e.g., first mounting hole 202, second mounting hole 204, and third mounting hole 402).

Although recess 401 includes three mounting holes (e.g., first mounting hole 202, second mounting hole 204, and third mounting hole 402), recess 401 arranged on an apparatus may include more than three mounting holes to accommodate electrical components of additional sizes and shapes. Although each mounting hole (e.g., first mounting hole 202, second mounting hole 204, and third mounting hole 402) of recess 401 is of a respective size and shape, each mounting hole (e.g., first mounting hole 202, second mounting hole 204, and third mounting hole 402) and any additional mounting holes of recess 401 may be of a size or a shape corresponding to that of an electrical component to secure the electrical component.

Figure 5A:
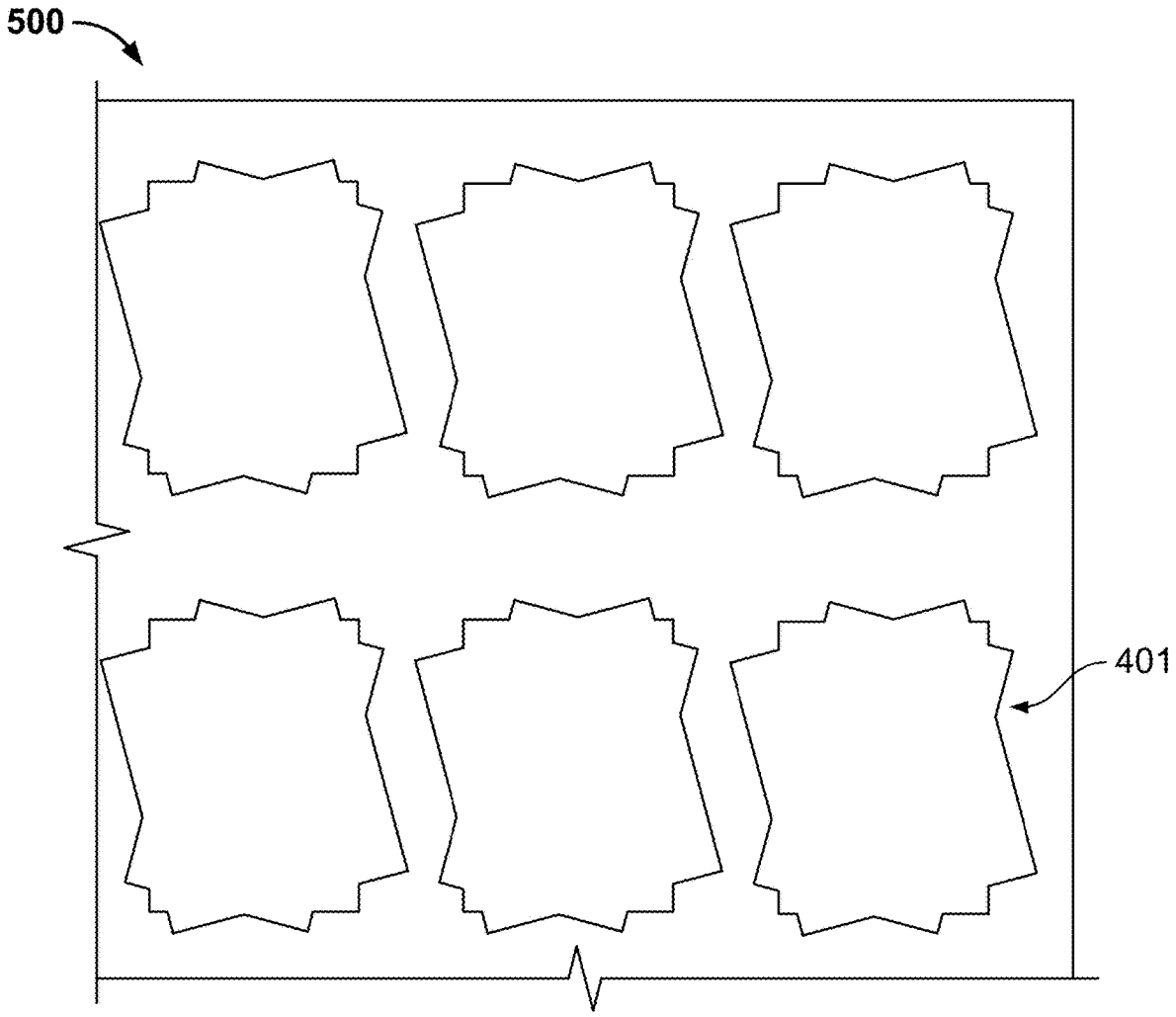
FIGS. 5A and 5B respectively show an illustrative plan view diagram and isometric view diagram of an apparatus with recesses similar to that of FIG. 4B, in accordance with some embodiments of the present disclosure.
Figure 5B:
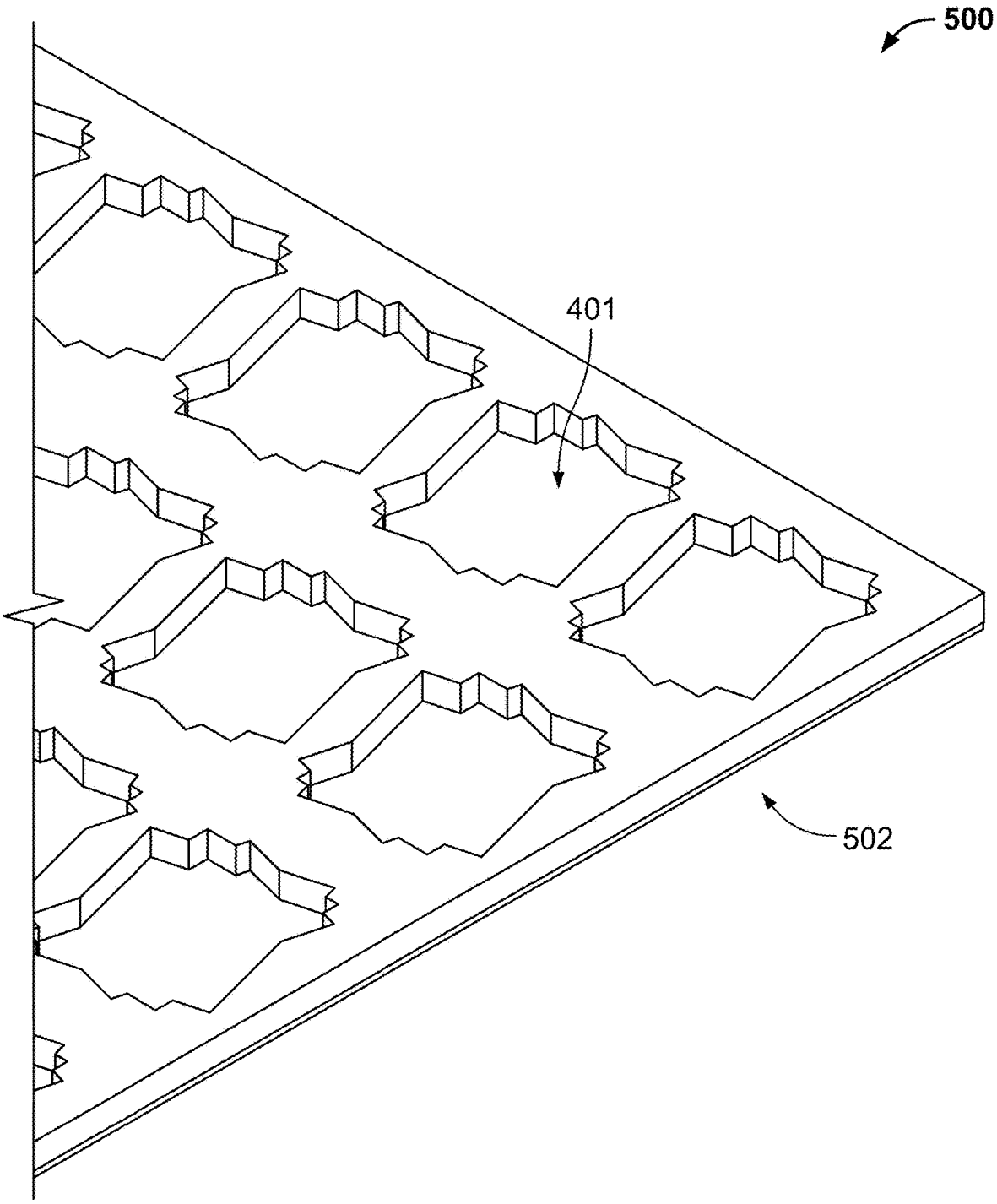

FIGS. 5A and 5B respectively show an illustrative plan view diagram and isometric view diagram of an apparatus 500 with recesses (e.g., recess 401) similar to that of FIG. 4B, in accordance with some embodiments of the present disclosure. Apparatus 500 includes at least one recess 401 with multiple mounting holes, where each mounting hole accommodates an electrical component of a respective size. Additionally, apparatus 500 includes a major plane, a top side in which the recesses are disposed, and a bottom side 502, where each of the top side and bottom side 502 are parallel to the major plane. In some embodiments, each recess 401 extends from the top side in a direction toward the bottom side 502. The depth of each recess 401 is based on the bottom side 502 such that the bottom side 502 forms further support, along with a respective mounting hole of a recess 401, to accommodate and hold an electrical component.

Although recesses 401 are uniformly distributed throughout apparatus 500 in a grid-like arrangement, recesses 401 may be distributed throughout apparatus 500 in any suitable manner. However, each recess 401 should not coincide with any other recess disposed in the apparatus 500 such that the recesses 401 cannot hold an electrical component in any one mounting hole of the recesses 401.

It will be understood that, while apparatus 500 depicts an embodiment in which bottom side 502 forms a solid base to hold, along with the recess 401, an electrical component, bottom side 502 may include holes, where each hole extends through the bottom side 502 and is disposed in each respective recess (e.g., recess 401). Each hole disposed within a respective recess (e.g., recess 401) may be of any size or shape that may be disposed within the respective recess (e.g., recess 401).

Figure 6:
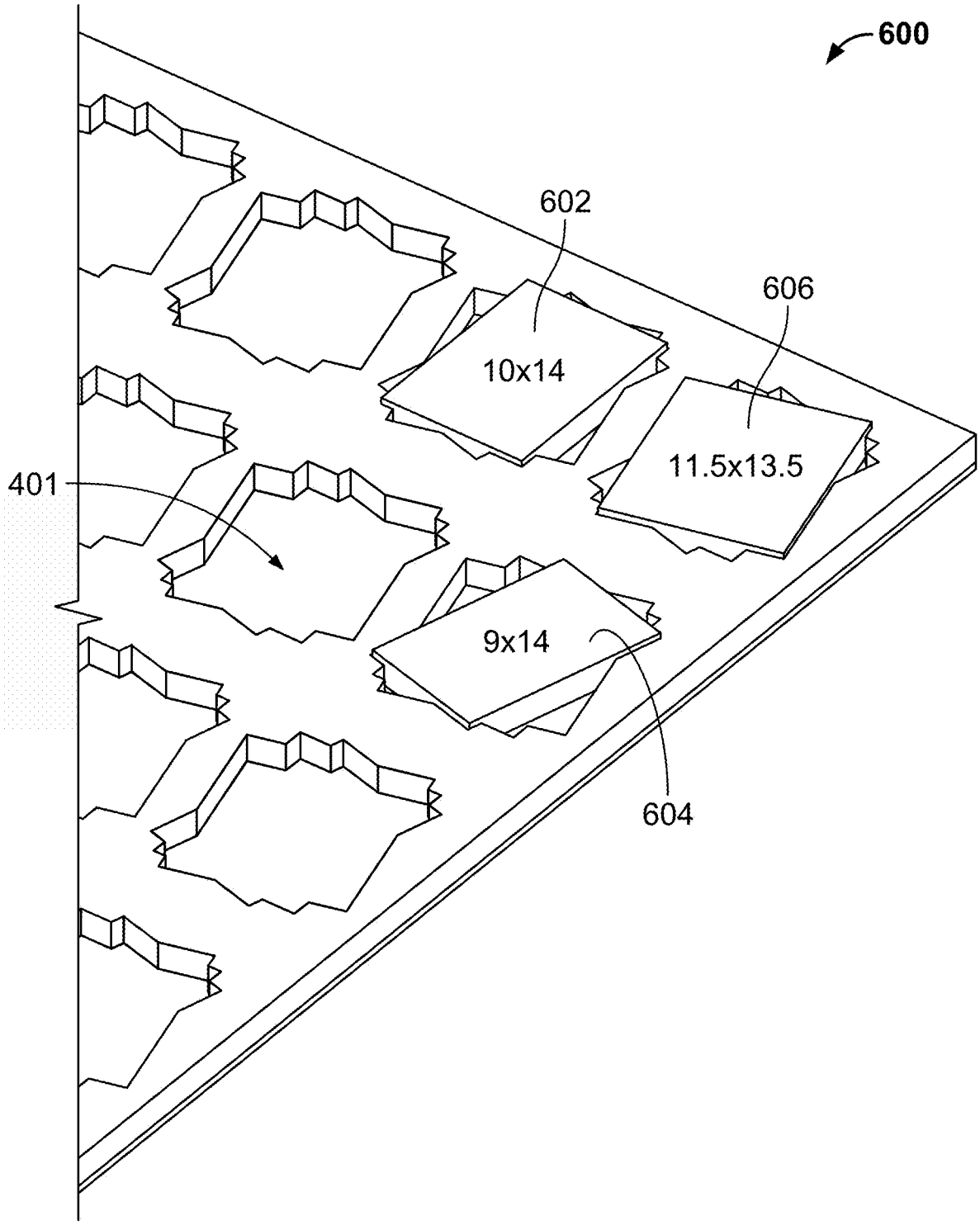
FIG. 6 shows an illustrative isometric view diagram of an apparatus similar to that of FIG. 5B holding electrical components of different sizes, in accordance with some embodiments of the present disclosure.

FIG. 6 shows an illustrative isometric view diagram of an apparatus 600 similar to that of FIG. 5B holding electrical components (e.g., first electrical component 602, second electrical component 604, and third electrical component 606) of different sizes, in accordance with some embodiments of the present disclosure. Each recess 401 includes mounting holes that are configured to accommodate each of the first electrical component 602, second electrical component 604, and third electrical component 606. Additionally, each recess 401 is configured to hold one electrical component of a respective size and respective shape once the electrical component (e.g., one of first electrical component 602, second electrical component 604, and third electrical component 606) is oriented and secured into a respective mounting hole of the respective size and respective shape. In some embodiments, one or more of the electrical components (e.g., first electrical component 602, second electrical component 604, and third electrical component 606) is an integrated circuit (IC) package. In some embodiments, one or more of the electrical components (e.g., first electrical component 602, second electrical component 604, and third electrical component 606) is a passive electrical component (e.g., a capacitor, an inductor, or any other suitable passive electrical component).

Figure 7:
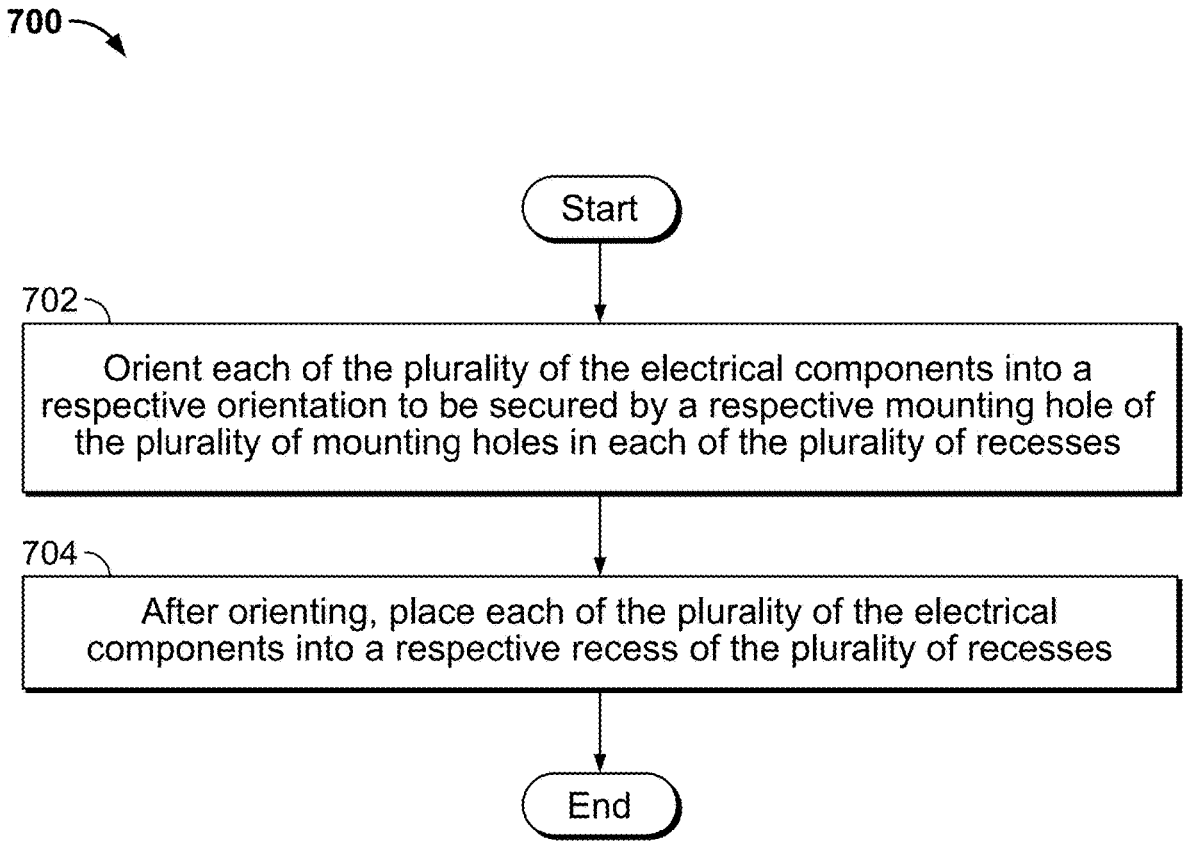
FIG. 7 shows a flowchart of illustrative steps for securing a plurality of electrical components in an apparatus, in accordance with some embodiments of the present disclosure.

FIG. 7 shows a flowchart of illustrative steps of a process 700 for securing a plurality of electrical components in an apparatus, in accordance with some embodiments of the present disclosure. In some embodiments, the referenced apparatus, recess, electrical components, and mounting holes may be implemented as apparatus 600, recess 401, electrical components (e.g. first electrical component 602, second electrical component 604, and third electrical component 606), and mounting holes (e.g., first mounting hole 202, second mounting hole 204, and third mounting hole 402), respectively. In some embodiments, the process 700 can be modified by, for example, having steps rearranged, changed, added, and/or removed.

At step 702, orient each of the electrical components into a respective orientation to be secured by a respective mounting hole of the plurality of mounting holes in each of the plurality of recesses. Each recess includes mounting holes that are configured to accommodate electrical components of various shapes and sizes. In some embodiments, one or more of the electrical components is an IC package. In some embodiments, one or more of the electrical components is a passive electrical component (e.g., a capacitor, an inductor, or any other suitable passive electrical component).

At step 704, after orienting each electrical component at 702, place each of the electrical components into a respective recess of the plurality of recesses. Each recess is configured to hold one electrical component of a respective size and respective shape once the electrical component is oriented and placed into a respective mounting hole of the respective size and respective shape.

The terms "an embodiment", "embodiment", "embodiments", "the embodiment", "the embodiments", "one or more embodiments", "some embodiments", and "one embodiment" mean "one or more (but not all) embodiments" unless expressly specified otherwise.

The terms "including", "comprising", "having" and variations thereof mean "including but not limited to", unless expressly specified otherwise.

The enumerated listing of items does not imply that any or all of the items are mutually exclusive, unless expressly specified otherwise.

The terms "a", "an" and "the" mean "one or more", unless expressly specified otherwise.

A description of an embodiment with several components in communication with each other does not imply that all such components are required. On the contrary a variety of optional components are described to illustrate the wide variety of possible embodiments. Further, although process steps, method steps, algorithms or the like may be described in a sequential order, such processes, methods, and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article, or a different number of devices/articles may be used instead of the shown number of devices or programs. The functionality and/or the features of a device may be alternatively embodied by one or more other devices which are not explicitly described as having such functionality/features. Thus, other embodiments need not include the device itself.

At least certain operations that may have been illustrated in the figures show certain events occurring in a certain order. In alternative embodiments, certain operations may be performed in a different order, modified, or removed. Moreover, steps may be added to the above-described logic and still conform to the described embodiments. Further, operations described herein may occur sequentially or certain operations may be processed in parallel. Yet further, operations may be performed by a single processing unit or by distributed processing units.

The foregoing description of various embodiments has been presented for the purposes of illustration and description. It is not intended to be exhaustive or to be limited to the precise forms disclosed. Many modifications and variations are possible in light of the above teaching.

What is claimed is:

1. An apparatus for holding a plurality of electrical components, the apparatus comprising:
- a major plane;
- a top side parallel to the major plane;
- a bottom side parallel to the major plane; and
- a plurality of recesses in the top side, wherein a depth of each of the plurality of recesses is based on the bottom side and each respective recess comprises:
  - a plurality of mounting holes, wherein each of the plurality of mounting holes is:
    - configured to accommodate a respective size of an electrical component, and
    - oriented at an angle other than ninety degrees from others of the plurality of mounting holes.

2. The apparatus of claim 1, wherein for each respective recess:
- each respective mounting hole of the plurality of mounting holes of the respective recess is of a rectangular shape.

3. The apparatus of claim 1, wherein:
- the apparatus is comprised of a plastic material, and
- for each recess of the plurality of recesses, each respective mounting hole of the plurality of mounting holes is to secure the electrical component of a respective size.

4. The apparatus of claim 1, wherein at least one of the plurality of electrical components is an integrated circuit (IC) package.

5. The apparatus of claim 1, wherein at least one of the plurality of electrical components is a passive electrical component.

6. The apparatus of claim 1, wherein a first mounting hole of a recess of the plurality of recesses is of a first size different from a second size of a second mounting hole of the recess.

7. The apparatus of claim 1, wherein a first mounting hole of a recess of the plurality of recesses is of a same size as a size of a second mounting hole of the recess.

8. The apparatus of claim 1, wherein the plurality of recesses is arranged in a grid.

9. The apparatus of claim 1, wherein the bottom side and a respective mounting hole is configured to support a respective electrical component in a respective recess of the plurality of recesses.

10. The apparatus of claim 1, wherein one or more recesses of the plurality of recesses extends from the top side to the bottom side.

11. A method for securing a plurality of electrical components in an apparatus comprising:
- a major plane;
- a top side parallel to the major plane;
- a bottom side parallel to the major plane; and
- a plurality of recesses in the top side, wherein a depth of each of the plurality of recesses is based on the bottom side and each respective recess comprises:
  - a plurality of mounting holes, wherein each of the plurality of mounting holes is:
    - configured to accommodate a respective size of an electrical component, and
    - oriented at an angle other than ninety degrees from others of the plurality of mounting holes, the method comprising:
- orienting each of the plurality of the electrical components into a respective orientation to be secured by a respective mounting hole of the plurality of mounting holes in each of the plurality of recesses, and
- after orienting, placing each of the plurality of the electrical components into a respective recess of the plurality of recesses.

12. The method of claim 11, wherein for each respective recess:
- each respective mounting hole of the plurality of mounting holes of the respective recess is of a rectangular shape.

13. The method of claim 11, wherein:
- the apparatus is comprised of a plastic material, and
- for each recess of the plurality of recesses, each respective mounting hole of the plurality of mounting holes is to secure the electrical component of a respective size.

14. The method of claim 11, wherein at least one of the plurality of electrical components is an integrated circuit (IC) package.

15. The method of claim 11, wherein at least one of the plurality of electrical components is a passive electrical component.

16. The method of claim 11, wherein a first mounting hole of a recess of the plurality of recesses is of a first size different from a second size of a second mounting hole of the recess.

17. The method of claim 11, wherein a first mounting hole of a recess of the plurality of recesses is of a same size as a size of a second mounting hole of the recess.

18. The method of claim 11, wherein the plurality of recesses is arranged in a grid.

19. The method of claim 11, wherein the bottom side and the respective mounting hole supports a respective electrical component of the plurality of electric components placed in the respective recess.

20. The method of claim 11, wherein one or more recesses of the plurality of recesses extends from the top side to the bottom side.

* * * * *